US008907818B2

(12) United States Patent
Chen et al.

(10) Patent No.: US 8,907,818 B2
(45) Date of Patent: Dec. 9, 2014

(54) BUS STOP AND SYSTEM PROVIDING TRAVEL INFORMATION IN RELATION TO BUSES

(71) Applicants: Te-Sheng Chen, Miaoli (TW); Xiao-Guang Li, Shenzhen (CN); Kuan-Hong Hsieh, New Taipei (TW); Yun Xiao, Shenzhen (CN); Shang-Hui Pi, Shenzhen (CN); Shuang Rui, Shenzhen (CN)

(72) Inventors: Te-Sheng Chen, Miaoli (TW); Xiao-Guang Li, Shenzhen (CN); Kuan-Hong Hsieh, New Taipei (TW); Yun Xiao, Shenzhen (CN); Shang-Hui Pi, Shenzhen (CN); Shuang Rui, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 60 days.

(21) Appl. No.: 13/729,061

(22) Filed: Dec. 28, 2012

(65) Prior Publication Data

US 2014/0049409 A1 Feb. 20, 2014

(30) Foreign Application Priority Data

Aug. 20, 2012 (CN) ..... 2012 1 0295973

(51) Int. Cl.
*G08G 1/123* (2006.01)
*G08G 1/005* (2006.01)
*G08G 1/133* (2006.01)

(52) U.S. Cl.
CPC ..... *G08G 1/123* (2013.01); *G08G 1/005* (2013.01); *G08G 1/133* (2013.01)
USPC ..... 340/995.17; 340/995.18; 340/993; 340/994; 701/117

(58) Field of Classification Search
CPC ..... G08G 1/123; G08G 1/133; G08G 1/127; B60B 1/2611; B60Q 1/50; B60Q 9/008; G01C 21/343
USPC ..... 340/995.17, 995.18, 994, 993, 995.23, 340/991, 988; 701/117, 124, 25, 26
See application file for complete search history.

(56) References Cited

U.S. PATENT DOCUMENTS

| | | | | |
|---|---|---|---|---|
| 5,483,454 | A * | 1/1996 | Lewiner et al. | 701/465 |
| 5,736,940 | A * | 4/1998 | Burgener | 340/994 |
| 5,774,072 | A * | 6/1998 | Wu | 340/994 |
| 6,006,159 | A * | 12/1999 | Schmier et al. | 701/465 |
| 6,374,176 | B1 * | 4/2002 | Schmier et al. | 701/465 |
| 7,394,403 | B2 * | 7/2008 | Winkler et al. | 340/994 |
| 7,394,404 | B2 * | 7/2008 | Kim | 340/994 |
| 7,538,691 | B2 * | 5/2009 | Horstemeyer | 340/994 |
| 7,880,645 | B2 * | 2/2011 | Park | 340/994 |
| 7,999,701 | B1 * | 8/2011 | Xu et al. | 340/994 |

(Continued)

*Primary Examiner* — Hoi Lau
(74) *Attorney, Agent, or Firm* — Novak Druce Connolly Bove + Quigg LLP

(57) ABSTRACT

A bus stop includes a storage unit, a communicating unit, a display unit, and a control unit. The communicating unit communicates with a server which is in communication with a plurality of buses, a plurality of stops which the buses will pass, and current locations of the buses. The display unit displays at least one route consisting of a plurality of bus stops including the bus stop. The control unit generates a request signal carrying the location of the bus stop to the server. The server determines current locations of the buses on a route which includes the bus stop, compares the real-time locations with the location of the bus stop to select a nearest bus travelling towards the bus stop. The display unit display a mark marking the bus stop. A related system is also provided.

8 Claims, 2 Drawing Sheets

(56) References Cited

U.S. PATENT DOCUMENTS

| | | | | |
|---|---|---|---|---|
| 8,643,512 | B2 * | 2/2014 | Hsieh et al. | 340/994 |
| 2002/0099500 | A1 * | 7/2002 | Schmier et al. | 701/200 |
| 2006/0074545 | A1 * | 4/2006 | Kim | 701/117 |
| 2010/0259421 | A1 * | 10/2010 | Kim et al. | 340/994 |
| 2012/0105256 | A1 * | 5/2012 | Hsieh et al. | 340/994 |
| 2014/0049409 | A1 * | 2/2014 | Chen et al. | 340/995.17 |
| 2014/0052365 | A1 * | 2/2014 | Chen et al. | 701/117 |
| 2014/0062731 | A1 * | 3/2014 | Chen et al. | 340/993 |

* cited by examiner

BUS STOP AND SYSTEM PROVIDING TRAVEL INFORMATION IN RELATION TO BUSES

CROSS-REFERENCE TO RELATED APPLICATIONS

Related subject matter is disclosed in co-pending U.S. patent application Ser. No. 13/729,059 with an and a title of BUS STOP AND SYSTEM CAPABLE OF PROVIDING TRAVELLING INFORMATION OF BUSES, which have the same assignees as the current application and were concurrently filed.

BACKGROUND

1. Technical Field

The present disclosure relates to bus travelling monitoring systems and, particularly, to a bus stop and a system capable of providing travel information relating to buses.

2. Description of the Related Art

Traditional bus stops show names of bus lines and names of individual stop platforms. However, the passengers can only guess at the arriving time of buses they wish to take, or traffic conditions in which the buses are travelling, which results in the passengers waiting in hope, often with no useful end result.

BRIEF DESCRIPTION OF THE DRAWING

The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
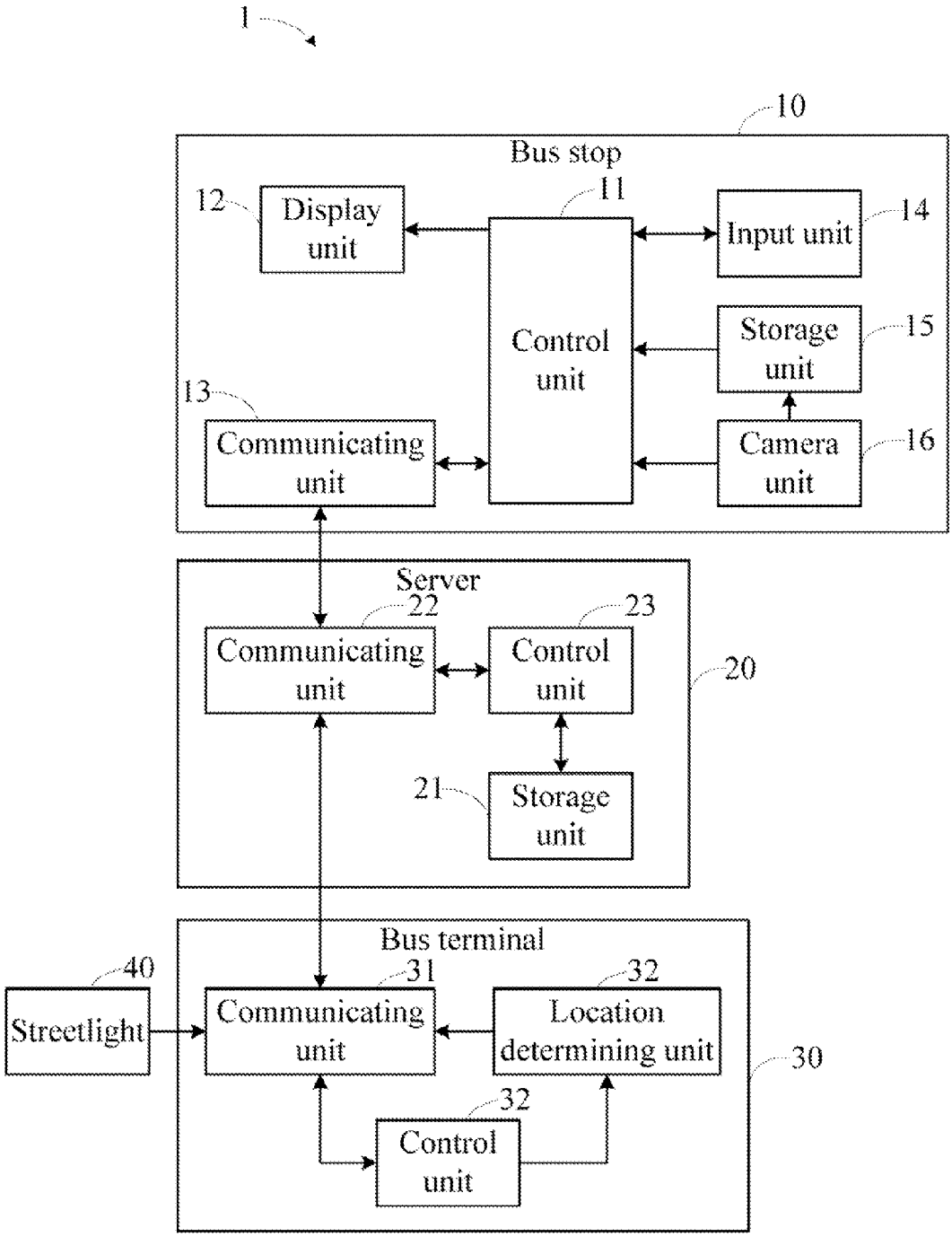
FIG. 1 is a block diagram of a system capable of providing travelling information relating to buses, according to an exemplary embodiment.

Referring to the figure, a system 1 capable of providing travelling information regarding buses includes a plurality of bus stops 10, a server 20, and a plurality of bus terminals 30. Each of the plurality of bus terminals 30 communicates with the plurality of bus stops 10 and the server 20 via a network, such as PLC (Power Line Communication), OPLC (Optical Power Line Communication), 3G, 4G, GPRS, CDMA, GSM, WiFi, Zigbee, Zwave, IR, NFC, and the like. Each of the plurality of bus terminals 30 is installed in a bus (not shown). In the embodiment, the server 20 is a computer.

Each bus terminal 30 includes a communicating unit 31, a location determining unit 32, and a control unit 33. The location determining unit 32 obtains one or more items of platform information of the bus stops 40 within a predetermined range, and further determines a current location of the bus terminal 30 according to the obtained platform information. The platform information includes a name of the bus stop and a location thereof. The control unit 33 controls the communicating unit 31 to transmit the current location of the bus terminal 30 as determined by the location determining unit 32, and an identification of the bus terminal 30, to the server 20. In the embodiment, the identification of the bus terminal 30 includes a bus line, and further includes a number of the bus terminals 30 if several of the plurality of bus terminals 30 belong to a same bus line. In an alternative embodiment, the location determining unit 32 determines the current location of the bus terminal 30 after predetermined time intervals, and the control unit 33 controls the communicating unit 31 to transmit the current location of the bus terminal 30 to the server 20 as each current location determination is made.

The server 20 includes a storage unit 21, a communicating unit 22, a processing unit 23, and a control unit 24. The storage unit 21 pre-stores a table recording a plurality of identifications of the bus terminals 30, a plurality of items of platform information relating to the bus stops which the bus terminals 30 (and therefore the bus) will pass by, and the current locations of the bus terminals 30. The communicating unit 22 communicates with each of the plurality of bus terminals 30. When the server 20 receives a current location and an identification of a bus terminal 30 via the communicating unit 20, the control unit 24 establishes a predetermined projected or expected current location as recorded in the table, and further determines whether the current location according to the communicating unit 20 is the same as that recorded in the table. When the current location from the unit 20 is not the same as that recorded in the table, the control unit 24 updates the current location recorded in the table by the current location actually received.

Each bus stop 10 includes a control unit 11, a display unit 12, a communicating unit 13, an input unit 14, and a storage unit 15. The communicating unit 13 communicates with the server 20. The storage unit 15 pre-stores the platform information relevant to the bus stop 10, and the platform information can correspond to and communicate with several different bus lines.

Figure 2:
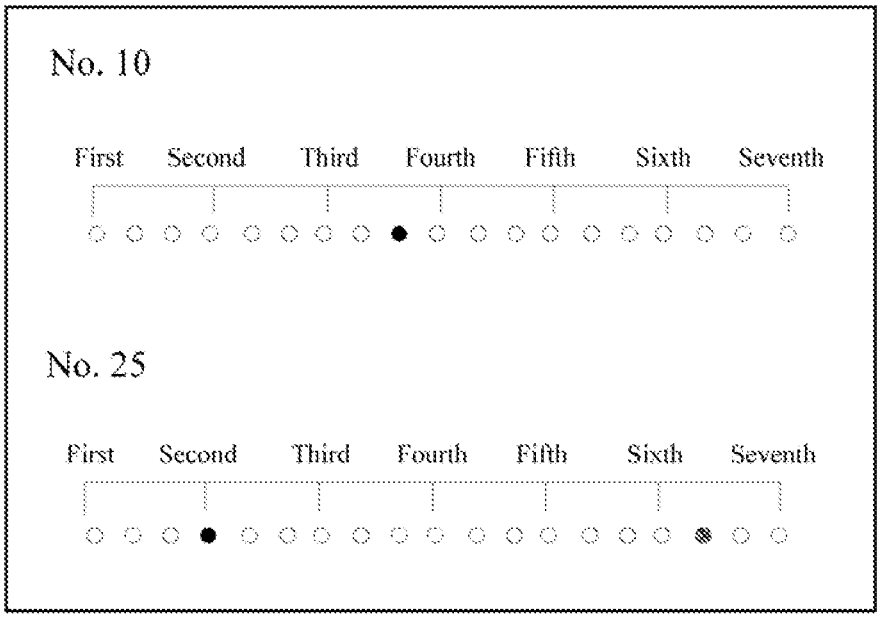
FIG. 2 shows a bus stop display of the system of FIG. 1 in a state of use.

Referring to FIG. 2, the display unit 12 displays bus stop names on any plurality of bus lines which actually pass the bus stop 10, according to the order of the bus stops along their respective routes, and each two adjacent bus stop names are connected by a line.

The control unit 11 obtains the location of the bus stop 10, generating a request signal which carries information as to the location of the bus stop 10, and controls the communicating unit 13 to transmit the request signal to the server 20.

When the server 20 receives a request signal transmitted by the bus stop 10, the control unit 23 determines one or more identifications of the bus terminals 30 recorded in the table corresponding to the location of the bus stop 10 carried by the request signal, and further determines one or more current locations of the bus terminals 30 travelling toward the bus stop 40 which transmitted the request signal, according to the determined identifications of the bus terminals 30. The control unit 23 further compares the current locations with the platform location of the bus stop 10 to determine the current location of the nearest bus terminal 30 (that is to say, the bus) travelling towards the bus stop 10, and controls the communicating unit 22 to transmit such current location to the bus stop 10. When the bus stop 10 receives the current bus location from the server 20, the control unit 11 controls the display unit 12 to display the determined current location. In an exemplary embodiment, the control unit 11 marks both the bus stop immediately before the nearest bus terminal 30 and the bus stop immediately after the nearest bus terminal 30 on the bus route. In another exemplary embodiment, the control unit 11 marks the line segment before the instant bus stop and the line after the nearest bus terminal 30.

The system 1 further includes a plurality of streetlights 40. Each of the plurality of streetlights 40 pre-stores a location thereof. The location determining unit 32 further obtains the locations of streetlights 40 within a predetermined range to update the current location of the bus terminal 30, according to the locations of the streetlights 40.

The bus stop 10 further includes a camera unit 16, mounted outside the bus stop 10 for taking images of the surroundings of the bus stop 10, which are stored in the storage unit 15. The control unit 11 controls the communicating unit 13 to transmit the images taken by the camera unit 16 to the server 20, being stored in the storage unit 21. The control unit 24 can determine the existence of abnormal traffic conditions by analyzing the images transmitted by the plurality of bus stops 10, and further determines the identifications of the bus terminals 30 travelling within or near to the determined location according to the table. The control unit 23 controls the communicating unit 22 to transmit the identifications of the bus terminals 30 and the traffic conditions being presently experienced by the bus terminals 30 which are moving towards the instant bus stop 10. The control unit 11 controls the display unit 12 to highlight a line segment corresponding to the determined locations of any abnormal traffic conditions, by means such as coloring the line segment(s).

In the embodiment, when an accident or emergency occurs, the input unit 14 can be operated by an user to generate an alarm. The control unit 11 obtains the image and the location information of the bus stop 10 from the storage unit 15, and controls the communicating unit 13 to transmit the image and the location information to the server 20. When the image and the location information are received from the bus stop 10 via the communication unit 22, the control unit 24 stores the image and the location information in the storage unit 21. Meanwhile, the control unit 24 automatically displays the image and the location information on a bus stop display unit (not shown). That is, upon receiving information from the bus stop 10, the server 20 automatically displays the information without any human intervention, this helps people who can view the display unit to know in a timely manner that an accident or emergency has occurred around the bus stop 10 and give help to those involved in the accident/emergency immediately.

It is understood that the present disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A bus stop comprising:

a storage unit configured for pre-storing platform information of the bus stop, the platform information comprising a name and a location of the bus stop;

a communicating unit configured for communicating with a server, wherein the server stores a table recording a plurality of identifications of bus terminals, a plurality of items of platform information of bus stops which the bus terminals pass by, and frequently updated real-time locations of the bus terminals; each bus terminal configured to be mounted on a corresponding bus, a display unit configured for displaying at least one route consisting of a plurality of bus stops including the bus stop; and a control unit configured for obtaining the location of the bus stop from the storage unit, generating a request signal carrying the location of the bus stop in response to a passenger's request, and controlling the communicating unit to transmit the request signal to the server to determine one or more bus terminals according to the location of the bus stop carried by the request and compare real-time locations of the determined bus terminals with the location of the bus stop to select a nearest bus terminal travelling towards the bus stop; the control unit further configured for controlling the display unit to display a mark marking the bus stop nearest the selected bus terminal on the at least one route according to the real-time location of the selected bus terminal.

2. The bus stop as claimed in claim 1, further comprising a camera unit configured for capturing an image of surrounding area of the bus stop and storing the images in the storage unit; wherein the control unit is further configured for controlling the communicating unit to transmit the image to the server to analyze traffic state of the bus stop nearest the selected bus terminal, and controlling the display unit to mark the bus stop nearest the selected bus terminal if the traffic state thereof is abnormal.

3. The bus stop as claimed in claim 2, further comprising an input unit configured for generating an alarming signal in response to a passenger's manual operation, the control unit further configured for obtaining the image and the location information of the bus stop from the storage unit thereof, and controlling the communicating unit to transmit the image and the location information to the server to enable the server to display the image of the surrounding area of the bus stop which transmits the alarming signal.

4. A system comprising a plurality of bus terminals, a plurality of bus stops, and a server communicating with the bus terminals and the bus stops, each of the bus terminals mounted in a bus;

each bus stop comprising:

a storage unit configured for pre-storing platform information of the bus stop, wherein the platform information comprising a name and a location of the bus stop;

a communicating unit configured for communicating with the server;

a display unit; and a control unit configured for obtaining the location of the bus stop from the storage unit, generating a request signal carrying the location of the bus stop in response to a passenger's request, and controlling the communicating unit to transmit the request signal to the server;

wherein each bus terminal is configured for obtaining platform information of the bus stops located within a predetermined distance from the bus terminal so as to determine a real-time location of the bus terminal, and transmitting the determined real-time location and an identification of the bus terminal to the server;

the server is configured for storing a table recording a plurality of identifications of a plurality of bus terminals, a plurality of items of platform information of the bus stops which the bus terminals pass by, and frequently updated real-time locations of the bus terminals; and further configured for determining one or more bus terminals according to the location of the bus stop carried by the request signal, comparing real-time locations of the determined bus terminals with the location of the bus stop to select a bus terminal nearest the bus stop and travelling towards the bus stop, and transmitting the determined real-time location of the selected bus terminal to the bus stop to control the display unit thereof to display the real-time location of the selected bus.

5. The system as claimed in claim 4, wherein each bus stop further comprising a camera unit mounted outside the bus stop, and configured for capturing an image of surrounding area of the bus stop and storing the images in the storage unit;

the control unit is further configured for controlling the communicating unit to transmit the image to the server to analyze traffic state of the bus stop nearest the selected bus terminal, and controlling the display unit to mark the bus stop nearest the selected bus terminal if the traffic state thereof is abnormal.

6. The system as claimed in claim 5, wherein the bus stop further comprising an input unit mounted outside the bus stop, configured for generating an alarming signal in response to a passenger's manual operation, the control unit further configured for obtaining the image and the location information of the bus stop from the storage unit thereof, and controlling the communicating unit to transmit the image and the location information to the server to enable the server to display the image of the surrounding area of the bus stop which transmits the alarming signal.

7. The system as claimed in claim 4, wherein the display unit further configured for displaying at least one route consisting of a plurality of bus stops including the bus stop.

8. The system as claimed in claim 4, further comprising a plurality of streetlights configured for pre-storing locations of the streetlights, the bus terminal further configured for obtaining the locations of the streetlights within a predetermined range to update the current location of the bus terminal.

* * * * *